US005089364A

United States Patent [19]

Lee et al.

[11] Patent Number: 5,089,364

[45] Date of Patent: Feb. 18, 1992

[54] ELECTROPHOTOGRAPHIC IMAGING MEMBERS CONTAINING A POLYURETHANE ADHESIVE LAYER

[75] Inventors: Lieng-Huang Lee, Webster, N.Y.; Diane C. Lincoln, Andover, Mass.; Christine J. Tarnawskyj, Rochester, N.Y.

[73] Assignee: Xerox Corporation, Stamford, Conn.

[21] Appl. No.: 605,063

[22] Filed: Oct. 26, 1990

[51] Int. Cl.[5] ..... G03G 5/47

[52] U.S. Cl. ..... 430/58; 430/64; 430/131; 156/331.7

[58] Field of Search ..... 430/64, 58, 131; 156/331.7

[56] References Cited

U.S. PATENT DOCUMENTS

| | | | |
|---|---|---|---|
| 3,713,821 | 1/1973 | Angelini | 430/64 |
| 3,775,108 | 11/1973 | Arai et al. | 96/1.8 |
| 3,891,435 | 6/1975 | Lee | 430/64 |
| 3,932,179 | 1/1976 | Perez-Albuerne | 96/1.5 |
| 3,932,561 | 1/1976 | Zaner | 156/331.7 |
| 4,240,861 | 12/1980 | Meckel et al. | 156/331.7 |
| 4,390,609 | 6/1983 | Wiedemann | 430/58 |
| 4,571,371 | 2/1986 | Yashiki | 430/62 |
| 4,578,333 | 3/1986 | Staudenmayer et al. | 430/60 |
| 4,654,284 | 3/1987 | Yu et al. | 430/930 |
| 4,820,601 | 4/1989 | Ong et al. | 430/58 |
| 4,870,129 | 9/1989 | Henning et al. | 156/331.7 |
| 4,921,769 | 5/1990 | Yuh et al. | 430/64 |

FOREIGN PATENT DOCUMENTS

| | | | |
|---|---|---|---|
| 63-221352 | 9/1988 | Japan | 430/64 |
| 63-280257 | 11/1988 | Japan | 430/64 |

*Primary Examiner*—Marion E. McCamish
*Assistant Examiner*—C. D. RoDee

[57] ABSTRACT

An electrophotographic imaging member is disclosed which contains a substrate having an electrically conductive surface, a dried continuous adhesive layer comprising a semi-interpenetrating network derived from a coating mixture comprising a blend of a self-crosslinkable polyurethane and a non-self-crosslinkable polyurethane, a thin homogeneous charge generating layer, and a charge transport layer comprising a film forming polymer.

20 Claims, No Drawings

ELECTROPHOTOGRAPHIC IMAGING MEMBERS CONTAINING A POLYURETHANE ADHESIVE LAYER

BACKGROUND OF THE INVENTION

This invention relates in general to electrophotographic imaging members, and more specifically, to the use of an aqueous dispersion or latex of a mixture of certain polyurethanes to form an adhesive layer during the preparation of an electrophotographic imaging member and to electrophotographic imaging members containing this adhesive layer.

In the art of electrophotography an electrophotographic plate comprising a photoconductive insulating layer on a conductive layer is imaged by first uniformly electrostatically charging the imaging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electrostatically attractable toner particles on the surface of the photoconductive insulating layer. The resulting visible toner image can be transferred to a suitable receiving member such as paper. This imaging process may be repeated many times with reusable photoconductive insulating layers.

The electrophotographic imaging member may be multilayered photoreceptor that comprises a substrate, a conductive layer, a charge blocking layer, an adhesive layer, a charge generating layer, and a charge transport layer.

Although excellent toner images may be obtained with multilayered photoreceptors, it has been found that when attempts to fabricate multilayered photoreceptors in which the charge generating layer is a thin homogeneous layer formed by vacuum deposition or sublimation on a solvent soluble or solvent swellable adhesive layer, a pattern of cracks form in the charge generating layer when coating solutions of charge transport material are applied to the thin charge generating layer. The pattern of cracks print out during development and the pattern is visible in the final xerographic copy. This pattern of cracks prevents use of these photoreceptors in systems that require long service life flexible belt photoreceptors in compact imaging machines that employ small diameter support rollers for photoreceptor belt systems operating in a very confined space. Small diameter support rollers are also highly desirable for simple, reliable copy paper stripping systems which utilize the beam strength of the copy paper to automatically remove copy paper sheets from the surface of a photoreceptor belt after toner image transfer. Unfortunately, small diameter rollers, e.g., less than about 0.75-inch (19-mm) diameter, raise the threshold of mechanical performance criteria to such a high level that photoreceptor belt seam failure can become unacceptable for multilayered belt photoreceptors. Thus, in advanced imaging systems utilizing multilayered belt photoreceptors, cracking and delamination has been encountered during belt cycling over small diameter rollers. Frequent photoreceptor cracking and delamination has a serious impact on the versatility of a photoreceptor and prevents its use in automatic electrophotographic copiers, duplicators and printers.

INFORMATION DISCLOSURE STATEMENT

U.S. Pat. No. 4,921,769 Yuh et al. issued on May 1, 1990—An imaging member is disclosed comprising an optional supporting substrate; a ground plane layer; a blocking layer; an optional adhesive layer; a photogenerator layer; and a charge transport layer, wherein the blocking layer comprises certain specified polyurethanes.

U.S. Pat. No. 4,571,371 to Yashiki issued—An electrophotographic photosensitive member is disclosed comprising a resin or adhesive layer between a substrate and a photoconductive layer. The adhesive layer may be composed of water soluble resins like polyacrylic acids and polyamide resins like polyurethane elastomers.

U.S. Pat. No. 4,578,333 to Staudenmayer et al. issued—An imaging member is disclosed comprising a charge generating layer comprising a photoconductive pigment such as a perylene compounds, a charge transport layer and an acrylonitrile copolymer interlayer disposed between the charge generating layer and the support. The acrylonitrile interlayer exhibits adhesion and freedom from cracking defects. See, for example, column 2, lines 8–13.

U.S. Pat. No. 3,932,179 to Perez-Albuerne issued—An electrophotographic element is disclosed comprising a conductive layer, a photoconductive layer and a polymeric interlayer. The interlayer is composed of (1) a hydrophobic polymer as a first polymeric phase and (2) a water on alkali soluble polymer as the second polymeric phase. This interlayer may serve as both a barrier and an adhesive layer. Polymers of poly(acrylic) acid are typical examples of the water-soluble polymer.

U.S. Pat. No. 3,775,108 to Arai et al. issued—An electrophotographic copying material is disclosed comprising an intermediary layer between a photoconductive layer and a support. The intermediary layer is composed of an acrylic emulsion, a polyurethane and a water soluble amino resin.

SUMMARY OF THE INVENTION

It is an object of the present invention to provide improved electrophotographic imaging members which overcomes the above-noted deficiencies.

It is yet another object of the present invention to provide improved electrophotographic imaging members which resist cracking.

It is still another object of the present invention to provide improved electrophotographic imaging members which resist delamination due to good adhesion at the interface.

It is another object of the present invention to provide improved electrophotographic imaging members which do not show print defects due to cracked interface.

It is yet another object of the present invention to provide improved electrophotographic imaging members which exhibit long cyclic electrical stability resulting from dimensional stability.

The foregoing objects and others are accomplished in accordance with this invention by providing a process for fabricating an electrophotographic imaging member comprising providing a substrate having an electrically conductive surface, applying an aqueous dispersion or aqueous latex comprising a semi-interpenetrating polymer network (semi-IPN) containing a self-cross-linkable polyurethane and a non-self-crosslinkable polyurethane, solidifying the polyurethanes to form a continuous adhesive layer, forming a thin homogeneous charge generating layer on the adhesive layer, applying a coating of a solution of a charge transport layer forming composition comprising a film forming polymer dissolved in an organic solvent and solidifying the polymer to form a charge transport layer. The photoreceptor prepared by this process comprises a substrate having an electrically conductive surface, an adhesive layer comprising a semi-IPN of a self-cross-linkable polyurethane and a non-self-crosslinkable polyurethane, a thin homogeneous charge generating layer, and a charge transport layer comprising a film forming polymer.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. The electrically insulating or conductive substrate can be flexible and in the form of an endless flexible belt. Preferably, the endless flexible belt shaped substrate comprises a commercially available biaxially oriented polyester known as Mylar, available from E. I. du Pont de Nemours & Co. or Melinex available from ICI. Other film-forming polymers, such as polyether sulfone, which has a linear thermal expansion coefficient matching that of polycarbonate, are also applicable as a substrate.

The thickness of the substrate layer depends on numerous factors, including beam strength and economical considerations, and thus this layer, for a flexible belt, may be of substantial thickness, for example, about 125 micrometers, or of minimum thickness less than 50 micrometers, provided there are no adverse effects on the final electrostatographic device. In one flexible belt embodiment, the thickness of this layer ranges from about 65 micrometers to about 150 micrometers, and preferably from about 75 micrometers to about 100 micrometers for optimum flexibility and minimum stretch when cycled around small diameter rollers, e.g. 19 millimeter diameter rollers. The surface of the substrate layer is preferably cleaned prior to coating to promote greater adhesion of the deposited coating. Cleaning may be effected, for example, by exposing the surface of the substrate layer to plasma discharge, ion bombardment and the like.

The conductive layer may vary in thickness over substantially wide ranges depending on the optical transparency and degree of flexibility desired for the electrostatographic member. Accordingly, the substrate may be quite thick it if it is in the form of a metal drum or plate. For a flexible photoresponsive imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal layer formed, for example, on the substrate by any suitable coating technique, such as a vacuum depositing technique. Typical metals include aluminum, zirconium, niobium, tantalum, vanadium and hafnium, titanium, nickel, stainless steel, chromium, tungsten, molybdenum, and the like. Typical vacuum depositing techniques include sputtering, magnetron sputtering, RF sputtering, and the like.

If desired, an alloy of suitable metals may be deposited. Typical metal alloys may contain two or more metals such as zirconium, niobium, tantalum, vanadium and hafnium, titanium, nickel, stainless steel, chromium, tungsten, molybdenum, and the like, and mixtures thereof. Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer. Generally, for rear erase exposure, a conductive layer light transparency of at least about 15 percent is desirable. The conductive layer need not be limited to metals. Other examples of conductive layers may be combinations of materials such as conductive indium tin oxide or copper iodide as a transparent layer for light having a wavelength between about 4000 Angstroms and about 7000 Angstroms or a conductive carbon black dispersed in a plastic binder as an opaque conductive layer. A typical electrical conductivity for conductive layers for electrophotographic imaging members in slow speed copiers is about $10^2$ to $10^3$ ohms/square.

If desired, the conductive layer can also be constructed from any suitable thin film of conductive polymers. Typical conductive polymers, include polyaniline, polyacetylene (stabilized against oxidation), polyphenylene, polythiophene, polypyrrole, and the like.

A hole blocking layer may be applied to the electrically conductive surface of the substrate. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. The blocking layer may be nitrogen containing siloxanes or nitrogen containing titanium compounds such as trimethoxysilyl propylene diamine, hydrolyzed trimethoxysilyl propyl ethylene diamine, N-beta-(aminoethyl) gamma-amino-propyl trimethoxy silane, isopropyl 4-aminobenzene sulfonyl, di(dodecylbenzene sulfonyl) titanate, isopropyl di(4-aminobenzoyl)isostearoyl titanate, isopropyl tri(N-ethylaminoethylamino)titanate, isopropyl trianthranil titanate, isopropyl tri(N,N-dimethyl-ethylamino)titanate, titanium-4-amino benzene sulfonatoxyacetate, titanium 4-aminobenzoate isostearate oxyacetate, $[H_2N(CH_2)_4]CH_3Si(OCH_3)_2$, (gamma-aminobutyl) methyl diethoxysilane, and $[H_2N(CH_2)_3]CH_3Si(OCH_3)_2$ (gamma-aminopropyl) methyl diethoxysilane, as disclosed in U.S. Pat. Nos. 4,291,110, 4,338,387, 4,286,033 and 4,291,110. The disclosures of U.S. Pat. Nos. 4,338,387, 4,286,033 and 4,291,110 are incorporated herein in their entirety. A preferred blocking layer comprises a reaction product between a hydrolyzed silane and the oxidized surface of a metal ground plane layer. The oxidized surface inherently forms on the outer surface of most metal ground plane layers when exposed to air after deposition. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. The blocking layer should be continuous and have a thickness of less than about 0.2 micrometer because greater thicknesses may lead to undesirably high residual voltage.

The adhesive layer of this invention may applied to the optional hole blocking layer or directly to the electrically conductive surface on the substrate if the blocking layer is incorporated in the adhesive layer. The adhesive layer coating composition comprises a blend of an aqueous dispersion of a self-crosslinkable polyurethane and a non-self-crosslinkable polyurethane. An aqueous dispersion is defined as a colloidal system containing particles (or globules) smaller than 1 micrometer, in which the particles are the dispersed phase and the solvent, the dispersion medium. Generally, the dispersion medium is water. The aqueous dispersions utilized in the adhesive coating of this invention are stable, comprise prepolymer globules dispersed in an aqueous medium, and are free of any solid particles larger than 1 micrometer. These globules are submicron in size. In contrast, an aqueous latex is defined as an emulsion containing oily droplets or low molecular weight oligomers dispersed in a medium such as water. The latex generally contains an emulsifier or surface-active agent, while the dispersion contains a built-in dispersant or self-dispersant. Since the prepolymer in the polyurethane dispersion has a molecular weight between 20,000 and 30,000, it forms globules instead of droplets, thus, they are generally called a dispersion instead of an emulsion. The aqueous polyurethane dispersions utilized in the coating mixtures of this invention are very stable and contain a relatively high solid content. A typical commercially available aqueous polyurethane dispersion has about a 30 to 40 percent by weight solids content, based on the total weight of the dispersion. These stable dispersions are easily dilutable. For example, an aqueous dispersion of a non-self-crosslinkable polyurethane (Witcobond W260, available from Witco Chemical Company) weighing about 2.35 grams may be diluted with a 7.65 grams of alcohol to obtain a stable dispersion comprises 0.8 percent by weight solids, based on the total weight of the dispersion. Although the expression "aqueous dispersion" will be frequently be referred to herein, it should be understood that in some situations an "aqueous latex" can be substituted for the "aqueous dispersion" because of the relatively low molecular weight of the prepolymer.

When two linear polymers are mixed in the liquid state (dispersion, emulsion, solution, or bulk liquid prepolymer), and then crosslinked in situ in the presence or absence of a catalyst, an interpenetrating polymer network (IPN) is formed. If only one of the two linear polymers becomes crosslinked, then it is a semi-interpenetreting polymer network (semi-IPN). Owing to the interwining of chains, the resulting networks are generally stronger than the pure blend without intertwining of chains. The above example of the blending of two polyurethanes is actually a semi-IPN. It is the formation of a semi-IPN that produces an adhesive layer with strong adhesive strength.

There are at least six processes (see Table 1) which have been used to prepare polyurethane dispersions: 1) dispersant, shear force process, 2) acetone process, 3) prepolymer mixing process, 4) melt-dispersion process, 5) ketimine/ketazin process, and 6) solids self-dispersing processes.

TABLE 1

| | Characteristic Features of Polyurethane Dispersions | | | | | |
|---|---|---|---|---|---|---|
| | Dispersant Shear Force Process | Acetone Process | Prepolymer Mixing Process | Melt-Dispersion Process | Ketimin/Ketazin Process | Solids Self-Dispersing Process |
| Polyhydroxy Compound | polyether (liquid) | linear, variable | polyethers, some polyesters | variable | variable | |
| Diisocyanate | TDI | variable | TDI, IPDI, $H_{12}$MDI | TDI, HDI, IPDI | variable | |
| Glycols | only small amounts | variable | dimethylol propionic acid | mainly ionic | variable | |
| Product before dispersion | nonionic NCO-prepolymers | polyurethane ionomers | NCO-prepolymer-ionomer | ionic-biuret-prepolymers | NCO-prepolymer + ketimine/ketazine | prepolymer |
| Dispersant | + | – | – | – | – | – |
| Solvent | 5–10% toluene | 10–70% acetone | often 10–30% N-methyl pyrrolidone | – | possibly 5–30% acetone | – |
| Shear force mixer | + | – | – | – | – | – |
| Temperature of dispersion | ~20° C. | ~50° C. | 20–80° C. | 50–130° C. | 50–80° C. | 15–30° C. |
| Procedure after dispersion | amine extension | acetone distill. | amine extension | polycondensation | possibly acetone distillation | curing agent added |
| End product | polyurethane-urea | polyurethane polyurethane-urea | polyurethane urea ionomer | polyurethane biuret | polyurethane urea | polyurethane |
| Solvent contents of the final dispersion | 2–8% | <0.5% | often 5–15% N-methyl-pyrrolidone | – | possibly <2% acetone | – |
| Particle size (nm) | 700–3000 | 30–100,000 | 100–500 | 30–10,000 | 30–1000 | 30–500 |
| Post curing temperature | >100° C. | – | – | 50–150° C. | – | >120° C. |

All these process require a prepolymer which generally contains an excess of isocyanate groups. All six processes can produce the non-self-crosslinkable polyurethane. However, only Processes No. 3, 5 and 6 can produce rather uniform submicron particles. Depending upon the addition of end-capping compounds, three of these above processes (No. 2, No. 3 and No. 4) can produce both 1) non-self-crosslinkable polyurethane and 2) self-crosslinkable polyurethane. Among the three processes, Process No. 3 is the prepolymer mixing process which is the only one that does not require the distillation of a solvent, such as acetone, from the dispersion, and can produce uniform submicron particles.

For the adhesive application of this invention, the polyurethane dispersion by the third process is the preferred process which will be illustrated in detail. However, it is not intended that this invention be limited to this process alone. The third process involves anionic, cationic or nonionic prepolymers. For the anionic prepolymer, the general method of preparation is as follows: The polyhydroxy compounds can be any suitable polyether or polyester. In a specific example cited in this application, it is a polyester with the following generic formula:

$$HO\left[R_1-O-\overset{\overset{\displaystyle O}{\|}}{C}-R_2\right]_x OH$$

wherein $R_1$ represents a substituted or unsubstituted aliphatic group containing from 1 to 30 or more carbon atoms, $R_2$ represents a substituted or unsubstituted aliphatic group containing from 1 to 30 or more carbon atoms or a substituted or unsubstituted aromatic group, and x represents a whole number of at least one.

The diisocyanates used have the generic formulae:

Aliphatic: $O=C=N-R-N=C=O$

Aromatic: $O=C=N-Ar-N=C=O$ wherein R represents a substituted or unsubstituted aliphatic group containing from 1 to 12 carbon atoms and Ar represents a substituted or unsubstituted aromatic group.

For example, the diisocyanates can be tolylene diisocyanate (TDI), isophorone diisocyanate (IPDI), 4,4'-dicyclohexyl-methane diisocyanate ($H_{12}MDI$), and the like.

Thus, prepolymer-ionomer with an average molecular weight of 20,000-30,000 containing an excess of isocyanate groups can be dispersed at 20° C.-80° C. in an aqueous solution containing 10%-30% n-methyl pyrrolidone (NMP), which does not require a distillation step to remove it from the dispersion, and can then be flashed out during drying. The resultant dispersion contains polymer globules of approximately 0.1 micrometer —0.5 micrometer (or 100 nm-500 nm) in size as the dispersed phase in water.

At the completion of dispersion formation, all residual isocyanate groups should have been consumed to form urethane linkages (—NH—CO—) and the polymer chains in the globules are generally, but not limited, to those terminated with hydroxy groups. Other functional groups are aziridinyl-, mercapto-, amino-, epoxy-, chloromethyl, carboxyl-, alkoxymethyl-, and the like. For example, if the terminal groups are epoxy groups, or amino groups, they should be more reactive than hydroxyl groups and the polyurethane tends to self-crosslink readily upon drying.

Generally, a tertiary amine is added to neutralize the carboxyl group and control the pH value to about 8. This is called the amine extension. In the final dispersion, there may be some residual tertiary amine and 5%-15% of n-methyl pyrrolidone.

For the anionic prepolymer-ionomer, the polycarboxylates provide good hydrophobic properties, while polysulfonates give excellent stable dispersions. These dispersions produce final products, e.g., films, of good mechanical stability, chemical stability, good adhesion and gloss and good solvent resistance. Thus, it is preferable to use the anionic dispersions as adhesives for photoconductors.

Though the above example illustrates anionic prepolymer-ionomers, in fact, a cationic prepolymer-ionomer can also be used. For example, the reaction of dibromide with a diamine can lead to quaternizing polyadditions. If one of these components contains a long-chain polyether-segment, a cationic ionomer is formed. Cationic polyurethanes with tertiary sulfonium groups are prepared when tert-aminoglycol is substituted for thioglycol(bis-2-hydroxy-ethyl sulfide).

In addition to cationic prepolymers, nonionic prepolymers have also been used. These prepolymers contain some built-in ionic centers via a modified diol as a diisocyanate. However, the disadvantages of non-ionic dispersions are their increased sensitivity to water, e.g., swelling, softening and possible hydrolytic decomposition.

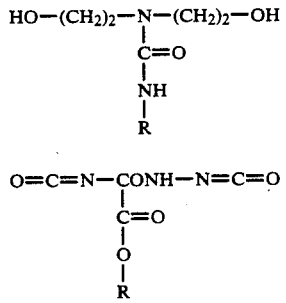

wherein R represents an alkyl group containing from 1 to 30 carbon atoms.

A non-self-crosslinkable polyurethane is defined as a polyurethane which is essentially linear and cannot form a three dimensional network without the addition of a catalyst or a curing agent, e.g., epoxides, triaziridines, or the use of external heating. Generally, non-self-crosslinkable polyurethane chains are terminated with hydroxyl-groups. The non-self-crosslinkable polyurethanes usually do not contain reactive terminal groups which can lead to condensation polymerization upon drying. Dried coatings of these non-self-crosslinkable polyurethanes are solid films soluble in solvents, e.g., acetone, methylene chloride, benzene, dimethyl formamide, and the like. Thus, a test to distinguish uncrosslinked and crosslinked polymers simply involves saturating a cotton pad with a suitable solvent and rubbing the polyurethane coating. The uncrosslinked coating should form an observable transfer of material to the pad during rubbing whereas the crosslinked coating should not form an observable transfer of material to the pad during rubbing. Polyurethanes dispersed in water are commercially available. Any suitable non-self-crosslinkable polyurethane dispersed in water may be utilized. Typical sources of non-self-crosslinkable polyurethane dispersed in water include, for example, Witcobond W260 dispersion (available from Witco Chemical Company). This non-self-crosslinkable polyurethane dispersion has a solids content of about 34%. The non-self-crosslinkable polyurethane is preferably a hydroxy-terminated polyurethane represented by the formula:

$$HO-[-CO-NH-R-NH-CO-O-R'-O-]_x-H$$

wherein R and R' are unsubstituted or substituted alkyl groups having 1 to 10 carbon atoms and x is 1 to about 5000. The substitutions may be lower alkyl groups or aromatic groups.

The range of solids content for the aqueous dispersions containing the non-self-crosslinkable polyurethane is between about 30 percent and about 40 percent by weight, based on the total weight of the dispersion.

The anionic prepolymer-ionomers of the polyurethane can be synthesized, for example, by the reaction of the dihydroxy-functionalized monomer and a dihydroxycarboxylic acid such as, dimethylol propionic acid and the like, with a slight excess of diisocyanate in an inert solvent medium at a temperature usually below about 80° C., and preferably between about 20° C. and about 80° C. If desired, any suitable catalyst such as tertiary amines, dibutyltin diacetate or dibutyltin dilaurate may be employed to increase the rate of polymerization. The above reaction is illustrated as follows:

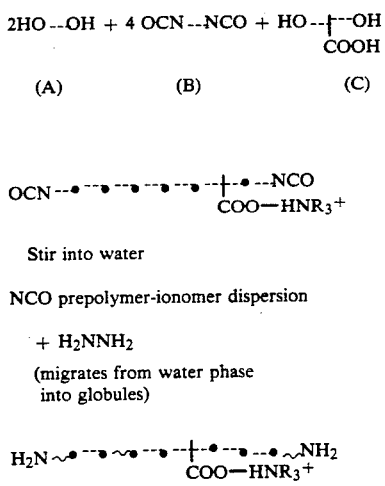

wherein R represents an alkyl group containing from 1 to 5 carbon atoms.

Examples of suitable solvents for the above prepolymerization include ethyl acetate, tetrahydrofuran, dioxane, dimethyl sulfoxide, dimethyl acetamide, and dimethylformamide. Also, the aforesaid reaction is generally accomplished in a period of from about 2 to about 24 hours depending on the nature of the reagents and reaction conditions.

Typical dihydroxy-functionalized monomers (A) include, for example, ethylene glycol, propylene glycol, hexamethylene glycol, hydroxy-terminated polyester, polyglycol of different molecular weights, and the like. Typical dihydroxycarboxylic acids (B) include, for example, dimethylol propionic acid, dimethylol butyric acid, dimethylol valeric acid, and the like. Typical examples of diisocyanates (C) that may be selected for the preparation of the copolyurethanes include methane diisocyanate, 1,2-ethane diisocyanate, 1,3-propane diisocyanate, 1,6-hexane diisocyanate, 1,4-cyclohexane diisocyanate, 1,4-dimethylenecyclohexane diisocyanate, isophorone diisocyanate, tolylene diisocyanates, methylene bis(4-phenyl isocyanate), and the like.

Any suitable film forming self-crosslinkable polyurethane may be utilized. A self-crosslinkable polyurethane is defined as the polyurethane containing reactive terminal groups which can further condense to form three-dimensional network in the absence of catalyst, curing agent, or heat. Generally, self-crosslinkable polyurethanes comprise typical terminal groups including amino-, epoxy-, aziridiny- and the like. Sufficient cross-linking is achieved upon air drying when the polymer becomes a solid film which is substantially insoluble in solvents. Thus, a test for suitable cross-linking simply involves saturating a cotton pad with a chlorinated solvent and rubbing the cross-linked polyurethane coating. The cross-linked coating should be substantially unaffected by the rubbing test and no observable transfer of material to the pad should occur during rubbing. It is important that the self-crosslinkable polyurethane prepolymers disperse or form a latex in water. Any self-crosslinkable polyurethane dispersed in water may be utilized. Polyurethanes dispersed in water are commercially available. Typical sources of polyurethane dispersed in water include, for example, Witcobond W240 dispersion (available from Witco Chemical Company). This self-crosslinkable polyurethane coating composition has a solids content of about 30%. The generic formula has been given in the above section on polyurethane dispersion.

The range of solids content for the aqueous dispersion containing the cross-linkable polyurethane is between about 30 percent and about 40 percent by weight, based on the total weight of the dispersion.

The self-crosslinkable polyurethane prepolymers can be synthesized as in the case of the non-self-crosslinkable prepolymers except the reactive terminal groups. The procedure for the preparation of the anionic dispersions has been described in the previous paragraph. The molecular weight range is between 20,000 and 30,000. For some occasions, a small amount of tri-functional monomers containing hydroxy- or isocyanato-groups may be added to promote crosslinking in the absence of a catalyst or external heating. Since these trifunctional monomers can affect shelf-life of the dispersion, it is important that only a small amount is used. In the case of Wicobond W-240 dispersion, the shelf-life is approximately six months.

One of the physical properties which can differentiate a non-self-crosslinkable polyurethane from a self-crosslinkable polyurethane is the ultimate elongation of the dry films. For example, the elongation for the non-self-crosslinkable film from Witcobond W-260 dispersion is 340%; while that for the self-crosslinkable film from Witcobond W-240 dispersion is only 70%.

Generally, satisfactory results may be achieved when the weight ratio of the non-self-crosslinkable polyurethane aqueous dispersion to the self-crosslinkable polyurethane aqueous dispersion is between about 90:10 and about 50:50. Preferably, the ratio of aqueous dispersion of the non-self-crosslinkable polyurethane aqueous dispersion to the self-crosslinkable polyurethane is between about 80:20 and about 60:40. On the basis of the solid content, the ratio should be between about 80:20 and about 60:40.

The optimum solids content of the diluted dispersion depends upon various factors including the process utilized for applying the dispersions. Thus, for example, the optimum solids content is generally lower when using a Bird applicator than when employing a gravure roll for applying the dispersions. For coating applications using a Bird-applicator, the mixture of the aqueous dispersions of cross-linkable polyurethanes and linear polyurethane is diluted with alcohol to form a solids contents of between about 0.6 percent by weight and about 1.2 percent by weight based on a total weight of solids in the final dispersion. The final concentration of the dispersion may also vary depending on the thickness of the adhesive layer desirable. For example, for a thickness of 0.8–1.2 micrometers, the above concentration range is rather appropriate. Thus, the range of concentration is between about 0.6 percent by weight and about 1.2 percent by weight solids, based on the total weight of solids. Optimum results are achieved with a final solids content of between about 0.7 percent by weight and about 0.9 percent by weight, based on the total weight of the solids in the dispersion. When the solids content is less than about 0.6 percent, the thickness of the adhesive layer is too thin and can result in poor adhesion. When the solids content is greater than about 1.2 percent, the thickness of the adhesive layer is too thick and can result in high residual potential of the final photoreceptor. If a gravure roll is used, the range of the solids content is preferably between about 7% and about 9%, and the optimum solids content is about 8%. Thus, depending upon the type of coating process utilized, it appears that there is a preferred range that can readily be experimentally determined based on the teachings herein. Moreover, other factors such as the relative speed of the applicator and the surface to be coated can affect the thickness of the final coating. Thus, for example, the type of gravure roll, the roll speed, the velocity of the surface to be coated, and the like can also affect the optimum solids content.

Any suitable alcohol may be utilized to dilute the aqueous dispersions to achieve the desired final solids content. Typical alcohols include, for example, isopropyl alcohol, isobutyl alcohol, ethyl alcohol, n-butyl alcohol, n-propyl alcohol, 2-ethoxyethanol and the like. A mixture of isopropyl alcohol and isobutyl alcohol is preferably utilized to provide greater control the rate of drying of the deposited coating. For example, if drying is taking place too slowly with isobutyl alcohol alone and too rapidly with isopropyl alcohol, a mixture of the two alcohols can provide an intermediate drying speed that might be most suitable for the type of coating and drying technique employed. The ratio of isopropyl alcohol/isobutyl alcohol can range from 100 percent to 60 percent by weight of isopropyl alcohol and from 0 percent to 40 percent isobutyl alcohol. A preferred mixture of isopropyl alcohol and isobutyl alcohol comprises about 60 percent by weight of isopropyl alcohol and about 40 percent by weight isobutyl alcohol. In the process of dilution, the total volume of isopropyl alcohol should be added, and then followed by the gradual addition of isobutyl alcohol while stirring the dispersion. Ethyl alcohol and methyl alcohol tend to evaporate too rapidly and n-butanol tends to dry too slowly. In another preferred embodiment, the dispersion medium comprises isopropyl alcohol (IPA) and an amount of water equal to the amount of original urethane aqueous dispersion used. The dispersion may be prepared by any suitable technique. A typical technique includes blending the self-crosslinkable and non-self-crosslinkable polyurethane dispersions first, then adding water (if used) and then adding the alcohol(s) slowly while mixing. If an aqueous dispersion of polyurethane dispersed in water is applied as a coating without the addition of an alcohol diluent, the dried coating is in the form of a powder and is not continuous. Thus, it is important that water miscible alcohol be utilized as a diluent additive. Generally, satisfactory results are achieved with a final dispersion containing from about 1.7 percent and about 2 percent by weight water and from about 98.3 percent and about 98 percent by weight alcohol based on the total weight of the final dispersion or latex.

Since the polyurethane dispersions are self-dispersable, there is no need for an external dispersant. However, in some cases involving mixtures other than a dispersion, an emulsifier may be required.

Any suitable coating technique may be utilized to apply the adhesive layer. Typical coating techniques include, for example, drawbar, gravure, spraying, dip coating, roll coating, wire wound rod coating, Bird applicator coating, and the like.

Since the thickness of the final solidified layer is affected by the solids content of the dispersion, the specific coating application technique used and the particular drying conditions utilized, a wide range of solids content in the dispersion may be utilized depending upon the final dried adhesive layer thickness desired. Thus, for example, for application techniques utilizing spraying, a low solids content may be desirable compared to application techniques utilizing gravure coating.

Any suitable drying technique may be utilized to dry the deposited adhesive layer. Typical drying techniques include air drying, oven drying, forced air oven drying, infrared radiation drying, air drying, zone drying, multistage drying, and the like. For example, satisfactory coating have been achieved with air drying for 30 minutes. Similar coatings have been obtained by oven drying at 105° C. for about 5 minutes. If desired, the multistage drying technique may be utilized for large scale coating operations in which the applied coating is subjected to higher temperature at different stages of heating. For example, the first stage might involve a temperature of about 80° C., the second stage about 115° C. and the last stage about 130° C. For multiple stage drying, the heating time at each zone can be very short, e.g., 24–26 seconds.

Generally, satisfactory results are achieved with an adhesive layer having a dried thickness between about 400 Angstroms and about 1800 Angstroms. Preferably, the dried thickness of the adhesive is between about 800 Angstroms and about 1200 Angstroms. When dried adhesive layer thickness is less than about 400 Angstroms, adhesion begins to deteriorate noticeably. When the adhesive layer thickness is greater than about 1500 Angstroms, the residual potential on the electrophotographic imaging member begins to build up during image cycling and can cause high background deposits in the final electrophotographic copy. The dried adhesive layer of this invention comprises a solid blend of the non-self-crosslinkable polyurethane and the self-crosslinkable polyurethane that prevents crack formation in the charge generating layer during the application of a charge transport coating composition that contains an organic solvent that normally attacks conventional adhesive layers such as polyesters (e.g. duPont 49,000 polyester, available from E. I. duPont de Nemours and Company and Vitel PE100 polyester, available from Goodyear Tire & Rubber).

Surprisingly, when the adhesive layer comprises either 100 percent non-self-crosslinkable polyurethane or 100 percent self-crosslinkable polyurethane, cracks form in the charge generating layer during application of a charge transport layer coating composition comprising a film forming polymer and an organic solvent. Moreover, photoreceptors prepared with adhesive layers comprising 100 percent cross-linkable polyurethane exhibited poor adhesion between the adhesive layer and the charge generating layer and delaminated during cycling over small diameter rollers. Thus, it is the semi-interpenetrating polymer networks that form the tough adhesive layer which provides good adhesion and toughness but not the brittleness of the crosslinked interface or the poor adhesion of the non-self-crosslinked interface.

Any suitable charge generating layer may be applied onto the adhesive layer of this invention. Typical charge generating materials may be vacuum deposited include benzimidazole perylenes, various phthalocyanine pigment such as chloroindium phthalocyanine, the X-form of metal free phthalocyanine described in U.S. Pat. No. 3,357,989, metal phthalocyanines such as vanadyl phthalocyanine, titanyl phthalocyanine and copper phthalocyanine, dibromoanthanthrone, squarylium, quinacridones available from DuPont under the tradename Monastral Red, Monastral violet and Monastral Red Y, Vat orange 1 and Vat orange 3 tradenames for dibromoanthanthrone pigments, substituted 2,4-diaminotriazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange, and the like. Other suitable photogenerating materials known in the art may also be utilized, e.g., azo pigments and chalcogenides such as arsenic triselenide, arsenic tritelluride, trigonal selenium, if desired. These charge generating layers are thin and homogeneous. Generally, the thickness of these thin homogeneous charge charge generating layers is between about 5000 Angstroms and 9000 Angstroms determined by a crystal monitor. Preferably, the thickness of these thin homogeneous charge generating layers is between about 8000 Angstroms and about 9000 Angstroms. When the thickness of these thin homogeneous charge charge generating layers is less than about 5000 Angstroms thick, the electrical sensitivity becomes too low. When the thickness is greater than about 9000 angstroms thick, the dark discharge potential becomes too high. Any suitable and conventional technique may be utilized to apply the photogenerating layer coating mixture. Typical application techniques include vacuum deposition, sublimation, coating from a dispersion and the like. Coating dispersions comprise finely divided charge generating particles dispersed in a film forming binder.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in the multilayered photoconductor of this invention comprises from about 25 percent to about 75 percent by weight of at least one charge transporting aromatic amine compound, and about 75 percent to about 25 percent by weight of a polymeric film forming resin in which the aromatic amine is soluble.

The charge transport layer forming mixture preferably comprises an aromatic amine compound of one or more compounds having the general formula:

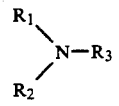

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free form electron withdrawing groups such as $NO_2$ groups, CN groups, and the like.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamino-2-methylphenyl)phenylmethane; 4'-4''-bis(diethylamino)-2',2''-dimethyltriphenylmethane, N,N'-bis(alkylphenyl)-[1,1'-biphenyl]-4,4'-diamine wherein the alkyl is, for example, methyl, ethyl, propyl, n-butyl, etc., N,N'-diphenyl-N,N'-bis(chlorophenyl)-[1,1'-biphenyl]-4,4'-diamine, N,N'-diphenyl-N,N'-bis(3''-methylphenyl)-(1,1'-biphenyl)-4,4'-diamine, and the like dispersed in an inactive resin binder.

Any suitable inactive resin binder soluble in methylene chloride or other suitable solvent may be employed in the process of this invention. Typical inactive resin binders soluble in methylene chloride include polycarbonate resin, polyvinylcarbazole, polyester, polyarylate, polyacrylate, polyether, polysulfone, and the like. Molecular weights can vary from about 20,000 to about 150,000. Typical organic solvents for the resin binder in the charge transport layer coating mixture will normally dissolve conventional adhesive layer materials. Thus, methylene chloride, 1,1,2-trichloroethane, tetrahydrofuran, toluene, or mixtures thereof will dissolve a polyester adhesive layer. Since the the vacuum deposited or sublimed charge generating layer appears porous to solvents such a methylene chloride, the organic solvent can penetrate the charge generating layer and attack a conventional adhesive layer.

Any suitable and conventional technique may be utilized to mix and thereafter apply the charge transport layer coating mixture to the charge generating layer. Typical application techniques include spraying, roll coating, wire wound rod coating, and the like. Drying of the deposited coating may be enhanced by any suitable conventional technique such as oven drying, infra red radiation drying, air drying and the like because it softens the underlying adhesive and slightly imbeds loose generation layer pigment. It also reduces the thermal stresses in the charge generator layer.

Generally, the thickness of the hole transport layer is between about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

The preferred electrically inactive resin materials are polycarbonate resins have a molecular weight from about 20,000 to about 150,000, more preferably from about 50,000 to about 120,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 120,000, available as Makrolon from Farbenfabricken Bayer A. G. and a polycarbonate resin having a molecular weight of from about 20,000 to about 50,000 available as Merlon from Mobay Chemical Company. Methylene chloride solvent is a desirable component of the charge transport layer coating mixture for adequate dissolving of all the components and for its low boiling point. A solvent mixture containing methylene chloride and 1,1,2-trichloroethene may be utilized.

Examples of photosensitive members having at least two electrically operative layers include the charge generator layer and diamine containing transport layer members disclosed in U.S. Pat. Nos. 4,265,990, 4,233,384, 4,306,008, 4,299,897 and 4,439,507. The disclosures of these patents are incorporated herein in their entirety.

Other layers such as conventional electrically conductive ground strip along one edge of the belt in contact with the conductive layer, blocking layer, adhesive layer or charge generating layer to facilitate connection of the electrically conductive surface of the photoreceptor substrate to ground or to an electrical bias. Ground strips are well known and usually comprise conductive particles dispersed in a film forming binder.

Optionally, an overcoat layer may also be utilized to improve resistance to abrasion. In some cases an anti-curl back coating may be applied to the side opposite the photoreceptor to provide flatness and/or abrasion resistance. These overcoating and anti-curl back coating layers are well known in the art and may comprise thermoplastic organic polymers or inorganic polymers that are electrically insulating or slightly semiconductive. Overcoatings are continuous and generally have a thickness of less than about 10 micrometers. The thickness of anti-curl backing layers should be sufficient to substantially balance the total forces of the layer or layers on the opposite side of the supporting substrate layer. The total forces are substantially balanced when the belt has no noticeable tendency to curl after all the layers are dried. For example, for an electrophotographic imaging member in which the bulk of the coating thickness on the photoreceptor side of the imaging member is a transport layer containing predominantly polycarbonate resin and having a thickness of about 24 micrometers on a Mylar substrate having a thickness of about 76 micrometers, sufficient balance of forces can be achieved with a 13:5 micrometers thick anti-curl layer containing about 99 percent by weight polycarbonate resin, about 1 percent by weight polyester and between about 5 and about 20 percent of coupling agent treated crystalline particles. An example of an anti-curl backing layer is described in U.S. Pat. No. 4,654,284 the entire disclosure of this patent being incorporated herein by reference. A thickness between about 70 and about 160 micrometers is a satisfactory range for flexible photoreceptors. Thicknesses between about 85 micrometers and about micrometers 145 are preferred and optimum results are achieved with a photoreceptor having a thickness of between about 90 micrometers and about 135 micrometers.

If desired, the photoconductive belt, may have a conductive ground strip formed along edge of the belt. The ground strip may be prepared, for example, from a uniform dispersion of carbon black in a tack-free polyester adhesive diluted with a solvent. The ground strip dispersion can be applied with any suitable applicator such as brush, gravure roll, sprayer and the like. A typical ground strip has a width of about 10 mm and a bulk resistivity of about 1 ohm-cm.

Thus, the multilayered photoreceptors of this invention are free from the pattern of cracks formed in the charge generating layer when coating solutions of charge transport material are applied to thin charge generating layers overlying solvent soluble, swellable or diffusable adhesive layers. Also, the multilayered photoreceptor of this invention provide longer service life in the form of flexible belt photoreceptors in imaging machines that employ small diameter support rollers for photoreceptor belt systems. The long service life is achieved due to the dimensional stability and electrical stability of the photoreceptors of this invention.

A number of examples are set forth hereinbelow and are illustrative of different compositions and conditions that can be utilized in practicing the invention. Examples 1 through 7 are carried out at a laboratory scale; while Examples 8 through 12 were carried out in a pilot plant on a much larger scale. It should be noted that the equipment and the quantities of materials are very different. All proportions are by weight unless otherwise indicated. It will be apparent, however, that the invention can be practiced with many types of compositions and can have many different uses in accordance with the disclosure above and as pointed out hereinafter.

EXAMPLE I

A photoconductive imaging member was prepared by providing a titanium coated polyester (Melinex, available from ICI Inc.) substrate having a thickness of 3 mils and applying thereto, using a Bird applicator, a solution containing 2.592 gm 3-aminopropyltriethoxysilane, 0.784 gm acetic acid, 180 gm of 190 proof denatured alcohol and 77.3 gm heptane. This layer was then allowed to dry for 5 minutes at room temperature and 10 minutes at 135° C. in a forced air oven. The resulting blocking layer had a dry thickness of about 200–400 Angstroms. An adhesive interface layer was then prepared on top of the blocking layer by applying a coating containing 0.5 percent by weight based on the total weight of the solution of polyester adhesive (DuPont 49,000, available from E. I. du Pont de Nemours & Co.) in a 70:30 volume ratio mixture of tetrahydrofuran/cyclohexanone with a 0.5-mil Bird applicator. An adhesive interface layer was then prepared by the applying to the blocking layer a coating having a wet thickness of 0.5 mil and containing 0.5 percent by weight based on the total weight of the solution of polyester adhesive (DuPont 49,000, available from E. I. du Pont de Nemours & Co.) in a 70:30 volume ratio mixture of tetrahydrofuran/cyclohexanone with a Bird applicator. The adhesive interface layer was allowed to dry for 1 minute at room temperature and 10 minutes at 100° C. in a forced air oven. The resulting adhesive interface layer had a dry thickness of 800 to 1200 Angstroms. Benzimidazole perylene vacuum sublimed from powder form at approximately 580° C. was deposited on the adhesive layer to an optical absorption of 85–90 percent at 650 nm to form a charge generating layer having a thickness of about 5000 Angstroms. This photogenerator layer was overcoated with a charge transport layer. The charge transport layer was prepared by introducing into an amber glass bottle 5.61 grams of N,N'-diphenyl-N,N'-bis(3-methylphenyl)-1,1'-biphenyl-4,4'-diamine and 10.4 grams of polycarbonate resin having a molecular weight of from about 50,000 to 100,000 (Makrolon R, available from Farbensabricken Bayer A. G.). The resulting mixture was dissolved in 83.99 grams of methylene chloride. This solution was applied on the photogenerator layer using a Gardner coater and a 3-mil Bird applicator to form a coating. The resulting photoreceptor device containing all of the above layers was air dried at room temperature for 30 minutes and then at 135° C. for 20 minutes to form a coating having a thickness of 20 micrometers. The dried photoreceptor was tested for macrocracking by visual observation and for microcracking by microscopy. Numerous macrocracks and microcracks were observed. The macrocracks were greater than 660 micrometers in diameter and 35±30 micrometers in the overlapped width.

Generally, macrocracks include those cracks greater than 500 micrometers in length with an overlap of platelets of greater than 30 micrometers wide. These types of cracks are seen visually by the naked eye. Macrocracks between 100 and 500 micrometers can be verified with a microscope. Microcracks are defined as those cracks of a length less than 100 micrometers and a width of overlap less than one micrometer. These microcracks are not visible to the eye, but can be only observed under a microscope.

EXAMPLE II

The procedures described in Example I were repeated to form another test sample, except that instead of depositing the polyester adhesive layer described in Example I, an adhesive layer containing only an aqueous dispersion of a non-self-crosslinkable polyurethane was applied. This adhesive layer coating dispersion was prepared by stirring 2.35 grams of an aqueous dispersion of non-self-crosslinkable polyurethane (100 percent Witcobond W260 dispersion, 34 percent by weight solids, available from Witco Corporation) while slowly adding 97.65 grams of isopropyl alcohol. The resulting dispersion (0.8 percent by weight solids) was applied using a Gardner coater and 0.5 mil Bird applicator on top of the blocking layer (200–400 Angstroms). This adhesive was allowed to dry for 5 minutes at room temperature and for 5 minutes at 105° C. in a forced air oven. The resulting adhesive layer had a dry thickness of about 1000 Angstroms. After application and drying of the charge generating and charge transporting layers as described in Example I, the dried photoreceptor was tested for macrocracking by visual observation and for microcracking by microscopy. Numerous macrocracks and microcracks were observed. The size of the macrocracks was greater then 600 micrometers.

EXAMPLE III

The procedures described in Example I were repeated to form another test sample, except that instead of depositing the polyester adhesive layer described in Example I, an adhesive layer containing only an aqueous dispersion of a non-self-crosslinkable polyurethane was applied. This adhesive layer coating dispersion was prepared by stirring 2.67 grams of an aqueous dispersion of non-self-crosslinkable polyurethane (100 percent Witcobond W260 dispersion, 34 percent by weight solids, available from Witco Corporation) while slowly adding 97.33 grams of isopropyl alcohol. The resulting dispersion (0.8 percent by weight solids) was applied using a Gardner coater and 0.5 mil Bird applicator on top of the blocking layer (200–400 Angstroms). This adhesive was allowed to dry for 10 minutes at room temperature and for 5 minutes at 105° C. in a forced air oven. The resulting adhesive layer had a dry thickness of 950 Angstroms. After application and drying of the charge generating and charge transporting layers as described in Example I, the dried photoreceptor was tested for macrocracking by visual observation and for microcracking by microscopy. No macrocracks and some microcracks were observed.

EXAMPLE IV

The procedures described in Example I were repeated to form another test sample, except that instead of depositing the polyester adhesive layer described in Example I, an adhesive layer of this invention was applied. This adhesive layer coating dispersion was prepared by stirring 1.07 grams of an aqueous dispersion of non-self-curable polyurethane (100 percent Witcobond W260 dispersion, 34 percent by weight solids, available from Witco Corporation) and 1.41 grams of an aqueous dispersion of self-crosslinkable polyurethane (100 percent Witcobond W240 dispersion, 30 percent by weight solids, available from Witco Corporation) while slowly adding 95.72 grams of isopropyl alcohol. The resulting dispersion containing a 60:40 weight ratio of non-self-crosslinkable polyurethane to cross-linkable polyurethane, (0.8 percent by weight solids) was applied using a Gardner coater and 0.5 mil Bird applicator on the top of the blocking layer (200–400 Angstroms). This adhesive was allowed to dry for 10 minutes at room temperature and for 5 minutes at 105° C. in a forced air oven. The resulting adhesive layer had a dry thickness of about 1000 Angstroms. After application and drying of the charge generating and charge transporting layers as described in Example I, the dried photoreceptor was tested for macrocracking by visual observation and for microcracking by microscopy. No macrocracks and microcracks were observed.

EXAMPLE V

The procedures described in Example I were repeated to form another test sample, except that instead of depositing the polyester adhesive layer described in Example I, an adhesive layer of this invention was applied. This adhesive layer coating dispersion was prepared by stirring 1.07 grams of an aqueous dispersion of non-self-crosslinkable polyurethane (100 percent Witcobond W260 dispersion, 34 percent by weight solids, available from Witco Corporation) and 1.41 grams of an aqueous dispersion of self-crosslinkable polyurethane (100 percent Witcobond W240 dispersion, 30 percent by weight solids, available from Witco Corporation) while slowly adding 95.07 grams of isopropyl alcohol and 2.48 grams of water. The resulting dispersion containing a 60:40 weight ratio of non-self-crosslinkable polyurethane to self-crosslinkable polyurethane (*0.8% by weight solids) was applied on top of the blocking layer (200–400 Angstroms). This adhesive was allowed to dry for 10 minutes at room temperature and for 5 minutes at 105° C. in a forced air oven. The resulting adhesive layer had a dry thickness of 970 Angstroms. After application and drying of the charge generating and charge transporting layers as described in Example I, the dried photoreceptor was tested for macrocracking by visual observation and for microcracking by microscopy. No macrocracks and microcracks were observed.

EXAMPLE VI

The procedures described in Example I were repeated to form another test sample, except that instead of depositing the polyester adhesive layer described in Example I, an adhesive layer of this invention was applied. This adhesive layer coating dispersion was prepared by stirring 1.07 grams of an aqueous dispersion of non-self-crosslinkable polyurethane (100 percent Witcobond W260 dispersion, 34 percent by weight solids, available from Witco Corporation) and 1.41 grams of an aqueous dispersion of self-crosslinkable polyurethane (100 percent Witcobond W240 dispersion, 30 percent by weight solids, available from Witco Corporation) while slowly adding 58.51 grams of isopropyl alcohol and 39.01 grams of isobutyl alcohol. The resulting dispersion containing a 60:40 weight ratio of non-self-crosslinkable polyurethane to self-crosslinkable polyurethane (0.8 percent by weight solids) was applied using a Gardner coater and 0.5 mil Bird applicator on top of the blocking layer (200–400 Angstroms). This adhesive was allowed to dry for 10 minutes at room temperature and for 5 minutes at 105° C. in a forced air oven. The resulting adhesive layer had a dry thickness of about 960 Angstrom. After application and drying of the charge generating and charge transporting layers as described in Example I, the dried photoreceptor was tested for macrocracking by visual observation and for microcracking by microscopy. No macrocracks and microcracks were observed.

EXAMPLE VII

The procedures described in Example I were repeated to form another test sample, except that instead of depositing the polyester adhesive layer described in Example I, an adhesive layer of this invention was applied. This adhesive layer coating dispersion was prepared by stirring 1.88 grams of an aqueous dispersion of non-self-crosslinkable polyurethane (100 percent Witcobond W260 dispersion, 34 percent by weight solids, available from Witco Corporation) and 0.53 gram of an aqueous dispersion of self-crosslinkable polyurethane (100 percent Witcobond W240 dispersion, 30 percent by weight solids, available from Witco Corporation) while slowly adding 58.55 grams of isopropyl alcohol and 39.04 grams of isobutyl alcohol. The resulting dispersion containing a 60:40 weight ratio of non-self-crosslinkable polyurethane to cross-linkable polyurethane (0.8 percent by weight solids) was applied using a Gardner coater and 0.5 mil Bird applicator on top of the blocking layer (200–400 Angstroms). This adhesive was allowed to dry for 10 minutes at room temperature and for 5 minutes at 105° C. in a forced air oven. The resulting adhesive layer had a dry thickness of about 1000 Angstroms. After application and drying of the charge generating and charge transporting layers as described in Example I, the dried photoreceptor was tested for macrocracking by visual observation and for microcracking by microscopy. No macrocracks and microcracks were observed.

EXAMPLE VIII

A photoconductive imaging member was prepared by providing a titanium coated polyester (Melinex, available from ICI Inc.) web substrate having a thickness of 3 mils and applying thereto, using a gravure coater, a solution containing 2.592 gm 3-aminopropyltriethoxysilane, 0.784 gm acetic acid, 180 gm of 190 proof denatured alcohol and 77.3 gm heptane. This layer was then-dried for 10 minutes at 135° C. in a zoned oven. The resulting blocking layer had a dry thickness of about 200–400 angstroms. A 15000 gram adhesive interface layer dispersion was then prepared by stirring 12.35 percent by weight of an aqueous dispersion of non-self-curable polyurethane (100 percent Witcobond W260 dispersion, 34 percent by weight solids, available from Witco Corporation) and 9.33 percent by weight of an aqueous dispersion of self-crosslinkable polyurethane (100 percent Witcobond W240 dispersion, 30 percent by weight solids, available from Witco Corporation) while slowly adding 46.99 percent by weight of isopropyl alcohol and 31.33 percent by weight of isobutyl alcohol. The resulting 60:40 non-self-crosslinkable polyurethane to self-crosslinkable polyurethane weight ratio 7 percent by weight dispersion was applied using a gravure roll at a rate of 50 feet per minute to the blocking layer. The adhesive layer was dried by passage through three temperature zones of a forced air oven maintained at 80° C., 115° C., and 130° C., respectively. The time in each zone was about 24–26 seconds. The resulting adhesive interface layer had a dry thickness of 0.05 micrometer. Benzimidazole perylene vacuum sublimed from powder form at approximately 580° C. was deposited on the adhesive layer to an optical absorption of 85–90 percent at 650 nm to form a charge generating layer having a thickness of about 6000 Angstroms. This photogenerator layer was overcoated with a charge transport layer. The charge transport layer was polycarbonate resin having a molecular weight of from about 50,000 to 100,000 (Makrolon R, available from Farbensabricken Bayer A. G). containing 35 wt % of N,N'-diphenyl-N,N'-bis(3-methylphenyl)-1,1'-biphenyl-4,4'-diamine based on polycarbonate. These two components were dissolved in a mixture of methylene chloride and 1,1,2-trichloroethane (65/35 by wt.) to form a solution of 14.5% in solids. This solution was applied on the photogenerator layer using the gravure coater. The resulting photoreceptor device containing all of the above layers was dried in the zone-heating oven with the three temperatures and the time in zones as described in the above to form a coating having a thickness of 25 micrometers. The rear, uncoated surface of the dried photoreceptor was then coated with an anti-curling coating containing polycarbonate. The resulting photoreceptor was tested for macrocracking by visual observation and for microcracking by microscopy. No macrocracks and microcracks were observed.

EXAMPLE IX

The procedures described in Example VIII were repeated to form another test sample, except that instead of depositing the adhesive layer described in Example VIII, another adhesive layer of this invention was applied. About 15,000 grams of this adhesive layer coating dispersion was prepared by stirring 16.47 percent by weight of an aqueous dispersion of non-self-crosslinkable polyurethane (100 percent Witcobond W260 dispersion, 34 percent by weight solids, available from Witco Corporation) and 4.67 percent by weight of an aqueous dispersion of cross-linkable polyurethane (100 percent Witcobond W240 dispersion, 30 percent by weight solids, available from Witco Corporation) while slowly adding 47.32 percent by weight of isopropyl alcohol and 31.54 percent by weight of isobutyl alcohol. The resulting 80:20 non-self-crosslinkable polyurethane to self-crosslinkable polyurethane weight ratio 7 percent by weight solids dispersion was applied using a gravure coater applicator to the blocking layer (200–400 Angstroms). The adhesive layer after drying had a thickness of 1000 Angstroms. After application and drying of the charge generating, charge transporting, and anti-curling layers as described in Example VIII, the dried photoreceptor was tested for macrocracking by visual observation and for microcracking by microscopy. No macrocracks and microcracks were observed.

EXAMPLE X

The procedures described in Example VIII were repeated to form another test sample, except that instead of depositing the adhesive layer described in Example VIII, another adhesive layer of this invention was applied. A 13,000 grams of this adhesive layer coating dispersion was prepared by stirring 21.18 percent by weight of an aqueous dispersion of non-self-crosslinkable polyurethane (100 percent Witcobond W260, 34 percent by weight solids, available from Witco Corporation) and 6.00 percent by weight of an aqueous dispersion of self-crosslinkable polyurethane (100 percent Witcobond W240, 30 percent by weight solids, available from Witco Corporation) while slowly adding 43.69 percent by weight of isopropyl alcohol and 29.13 percent by weight of isobutyl alcohol. The resulting 80:20 non-self-crosslinkable polyurethane to crosslinkable polyurethane weight ratio 9 percent by weight solids dispersion was applied using a gravure coater on top of the blocking layer having a dry thickness of 200–400 Angstroms. The adhesive layer after drying had a thickness of 1480 Angstroms. After application and drying in the zone-heating oven of the charge generating, charge transporting, and anti-curling layers as described in Example VIII, the dried photoreceptor was tested for macrocracking by visual observation and for microcracking by microscopy. No macrocracks and microcracks were observed.

EXAMPLE XI

The procedures described in Example VIII were repeated to form another test sample, except that instead of depositing the adhesive layer described in Example VIII, another adhesive layer of this invention was applied. About 15,000 grams of this adhesive layer coating dispersion was prepared by stirring 24.4 percent by weight of an aqueous dispersion of non-self-crosslinkable polyurethane (100 percent Witcobond W260 dispersion, 34 percent by weight solids, available from Witco Corporation) and 6.9 percent by weight of an aqueous dispersion of self-crosslinkable polyurethane (100 percent Witcobond W240 dispersion, 30 percent by weight solids, available from Witco Corporation) while slowly adding 41.2 percent by weight of isopropyl alcohol and 27.5 percent by weight of isobutyl alcohol. The resulting 80:20 non-self-crosslinkable polyurethane to self-crosslinkable polyurethane weight ratio 11 percent by weight solids dispersion was applied using a gravure coater on top of the blocking layer (200–400) Angstroms. The adhesive layer after drying in a zone-heating oven had a thickness of 1780 Angstroms. After application and drying of the charge generating, charge transporting, and anti-curling layers as described in Example VIII, the dried photoreceptor was tested for macrocracking by visual observation and for microcracking by microscopy. No macrocracks and microcracks were observed.

EXAMPLE XII

The procedures described in Example VIII were repeated to form additional test samples, except that the silane blocking layer was omitted and the non-self-crosslinkable polyurethane to self-crosslinkable polyurethane weight ratios in the adhesive layer and the adhesive layer thickness were varied. The adhesion between the charge generator layer and the underlying layers was measured using peel strength tests. Peel testing is described in ASTM D-93 Peel Strength Test (American Society for Testing Materials Standard methods). This testing method has been somewhat modified for the testing of photoreceptors. More specifically, the reversed peel strength was obtained by using a razor blade to separate enough of the charge generating layer (and charge transport layer) from the underlying layers to allow grippers to be attached, gripping the underlying layers with a stationary gripper and using the grippers of an Instron gauge to peel the generating layer and transport layer at an angle of 180 degrees from the original position of the gripped edge in a reversed mode. A similar test known as the normal peel test involves using a razor blade to separate enough of the charge generating layer (and underlying layers) from the overlying charge transport layer to allow grippers to be attached, gripping the charge transport layer with a stationary gripper and using the grippers of an Instron gauge to peel the generating layer (and underlying layers) at an angle of 180 degrees from the original position of the gripped edge. In assessing the adhesion of the adhesive layer, the reversed peel strength mode is deemed the most appropriate measurement. Also, the adhesion between the charge generator layer and the charge transport layer was tested using the normal peel strength test technique. The results of the tests are shown in Table 2. The results in Table 2 also show that the adhesive layer derived from the non-self-crosslinkable polyurethane from W-260 dispersion caused cracking.

TABLE 2

| Peel Strengths of Adhesive Layer A On Titanium Substrate (Without Silane Blocking Layer) | | | | | | |
|---|---|---|---|---|---|---|
| | | | Adhesive | Peel Strength | | |
| Adhesive | Treatment | Substrate | Thickness Angstrom | Normal (g/cm) | Reversed (g/cm) | Cracking |
| 60/40 W-260/W-240 | — | PET/Ti* | ~225 | 6.0 | 3.0 | No |
| 80/20 W-260/W-240 | — | PET/Ti* | ~250 | 5.0 | 3.0 | No |
| 80/20 W-260/W-240 | — | PET/Ti* | ~400 | 8.5 | 5.7 | No |
| 60/40 W--260/W-240 | — | PET/Ti* | ~435 | 4.8 | 5.7 | No |
| 100% W-260 | — | PET/Ti* | ~435 | 5.7 | 5.7 | Yes |

*PET/Ti is titanium coated polyester.

EXAMPLE XIII

The procedures described in Example VIII were repeated to form additional test samples, except that the non-self-crosslinkable polyurethane to self-crosslinkable polyurethane weight ratios in the adhesive layer and the adhesive layer thickness were varied. The adhesion between the charge generator layer and the substrate was measured using the reversed peel strength test device described in Example XII The results of the tests are shown in Table 3. It is important to point out that the peel strength alone is insufficient in predicting the results of crack-resistance.

TABLE 3

| Peel Strengths of Adhesive Layer A On Titanium Substrate (With Silane Blocking Layer) | | | | | | |
|---|---|---|---|---|---|---|
| | | | Adhesive | Peel Strength | | |
| Adhesive | Treatment | Substrate | Thickness Angstrom | Normal (g/cm) | Reversed (g/cm) | Cracking |
| 60/40 W-260/W-240 | — | PET/Ti/Si* | ~315 | 4.0<br>4.0 | 4.0<br>4.0 | No |
| 80/20 W-260/W-240 | — | PET/Ti/Si* | ~325 | 5.4<br>4.5 | 4.4<br>4.1 | No |
| 100% W-260 | — | PET/Ti/Si* | ~350 | 5.0<br>5.0 | 4.6<br>5.0 | Yes |
| 60/40 W--260/W-240 | Gravure Recleaned | PET/Ti/Si* | ~360 | 4.5<br>4.5 | 3.8<br>4.0 | No |

*PET/Ti/Si is titanium coated polyester that was coated with a silane blocking layer.

The absence or presence of a silane blocking layer generally did not affect the mechanical properties. However, the presence of a silane blocking layer provided greater electrical property stability at low relative humidities.

EXAMPLE XIV

Xerographic cycling tests conducted on the photoreceptors prepared in Examples 8 through 12 showed that the charge generating layers exhibited excellent optical absorption of at least 73 percent. Also, these photoreceptors had a high initial charging potential of over 1000 volts, low dark discharge potential ($V_{DDP}$) below 184 V/sec, sharp critical voltage relating to the slope of the photo-induced curve, low residual potential below 56 volts, high sensitivity (greater than 130 V/erg/cm$^2$ at 650 nm), good cyclic stability and good environmental stability.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A process for fabricating an electrophotographic imaging member comprising providing a substrate having an electrically conductive surface, applying an aqueous dispersion or aqueous latex comprising a non-self-crosslinkable polyurethane and a self-crosslinkable polyurethane, solidifying said polyurethanes to form a continuous adhesive layer having a semi-interpenetrating network structure, forming a thin homogeneous charge generating layer on said adhesive layer, applying a coating of a solution of a charge transport layer forming composition comprising a film forming polymer dissolved in an organic solvent and solidifying said polymer to form a charge transport layer.

2. A process for fabricating an electrophotographic imaging member according to claim 1 wherein the dried thickness of said adhesive layer is between about 400 Angstroms and about 1800 Angstroms.

3. A process for fabricating an electrophotographic imaging member according to claim 1 wherein the dried thickness layer of said adhesive layer is between 800 and 1200 Angstroms.

4. A process for fabricating an electrophotographic imaging member according to claim 1 wherein the solids content in said aqueous dispersion is between about 30 percent by weight and about 40 percent by weight, based on the total weight of said dispersion.

5. A process for fabricating an electrophotographic imaging member according to claim 1 wherein the solids weight ratio of said non-self-crosslinkable polyurethane to said self-crosslinkable polyurethane in said aqueous dispersion is between about 80:20 and about 60:40.

6. A process for fabricating an electrophotographic imaging member according to claim 1 wherein said self-crosslinkable polyurethane has terminal groups selected from aziridinyl-, mercapto-, amino-, epoxy-, chloromethyl, carboxyl- and alkoxymethyl- groups.

7. A process for fabricating an electrophotographic imaging member according to claim 1 wherein said non-self-crosslinkable polyurethane comprises polyurethanes predominantly terminated with hydroxy groups represented by the formula:

$$HO—[—CO—NH—R—NH—CO—O—R'—O—]_x—H$$

wherein R and R′ are unsubstituted or substituted alkyl groups having 1 to 10 carbon atoms and x is 1 to about 5000.

8. A process for fabricating an electrophotographic imaging member according to claim 1 forming on said adhesive layer a thin homogeneous charge generating layer having thickness of between about 5000 Angstroms and about 9000 Angstroms.

9. A process for fabricating an electrophotographic imaging member according to claim 8 including vacuum depositing said charge generating layer.

10. A process for fabricating an electrophotographic imaging member according to claim 8 including dispersion coating said charge generating layer.

11. A process for fabricating an electrophotographic imaging member according to claim 1 including forming a charge blocking layer having a thickness between about 200 and about 400 Angstroms between said electrically conductive surface and said adhesive layer.

12. A process for fabricating an electrophotographic imaging member according to claim 1 wherein said solution of said charge transport layer forming composition comprises a film forming polymer dissolved in an organic solvent which dissolves, swells or diffuses through said adhesive layer.

13. A process for fabricating an electrophotographic imaging member according to claim 1 wherein said substrate is a thin flexible web.

14. An electrophotographic imaging member comprising a substrate having an electrically conductive surface, a dried continuous adhesive layer comprising a semi-interpenetrating network derived from a coating mixture comprising a blend of a self-crosslinkable polyurethane and a non-self-crosslinkable polyurethane, a thin homogeneous charge generating layer, and a charge transport layer comprising a film forming polymer.

15. An electrophotographic imaging member according to claim 14 wherein the solids weight ratio of said non-self-crosslinkable polyurethane to the self-crosslinkable polyurethane in said adhesive layer is between about 80:20 and about 60:40.

16. An electrophotographic imaging member according to claim 14 wherein the thickness of said adhesive layer is between about 400 angstroms and about 1800 angstroms.

17. An electrophotographic imaging member according to claim 14 wherein the thickness of said adhesive layer is between about 800 angstroms and about 1200 angstroms.

18. An electrophotographic imaging member according to claim 14 wherein said thin homogeneous charge generating layer has thickness of between about 5000 angstroms and about 9000 angstroms.

19. An electrophotographic imaging member according to claim 14 wherein said charge generating layer comprises benzimidazole perylene.

20. An electrophotographic imaging member according to claim 14 wherein said substrate is a thin flexible web.

* * * * *